US005582141A

United States Patent [19]

Meyer

[11] Patent Number: 5,582,141

[45] Date of Patent: Dec. 10, 1996

[54] ENGINE VALVE HYDRAULIC ACTUATOR LOCATING MECHANISM

[75] Inventor: Lawrence L. Meyer, Northville, Mich.

[73] Assignee: Eaton Corporation, Cleveland, Ohio

[21] Appl. No.: 321,704

[22] Filed: Oct. 12, 1994

[51] Int. Cl.[6] ..... F01L 9/02

[52] U.S. Cl. ..... 123/90.12; 123/90.15

[58] Field of Search ..... 123/90.11, 90.12, 123/90.13, 90.14, 90.15, 90.33, 90.35, 90.37, 90.38

[56] References Cited

U.S. PATENT DOCUMENTS

| | | | |
|---|---|---|---|
| 2,384,701 | 9/1945 | Schreck | 123/90.12 |
| 3,209,737 | 10/1965 | Omotehara et al. | 123/90.12 |

FOREIGN PATENT DOCUMENTS

| | | | |
|---|---|---|---|
| 2552492 | 3/1985 | France | 123/90.12 |
| 4220689 | 1/1993 | Germany | 123/90.12 |
| 128508 | 4/1992 | Japan | 123/90.12 |

*Primary Examiner*—Weilun Lo
*Attorney, Agent, or Firm*—Loren H. Uthoff, Jr.

[57] ABSTRACT

An engine valve hydraulic actuator having an upper actuator housing slidably attached to a lower actuator housing is disposed between an oil supply header and an engine cylinder head where the supply header and the cylinder head are fixed relative to one another. The upper actuator housing is allowed to position and seal itself relative to the oil supply header and the lower actuator housing is allowed to position itself relative to the engine cylinder head to minimize friction and wear and thereby improve overall performance.

9 Claims, 1 Drawing Sheet

ENGINE VALVE HYDRAULIC ACTUATOR LOCATING MECHANISM

RELATED APPLICATIONS

The present application relates to application U.S. Ser. No. 08/306,794 entitled "Engine Hydraulic Valve Actuator Spool Valve" filed on Sep. 15, 1994 and assigned to the same assignee, Eaton Corporation, as this application.

BACKGROUND OF THE INVENTION

1. Field of the Invention

The present invention relates to a hydraulic engine valve actuator. More specifically, the present invention relates to a hydraulic engine valve actuator having a slidingly connected upper body and lower body disposed between two parallel seating surfaces.

2. Description of the Prior Art

A major obstacle to the efficient operation of internal combustion engines has been the timing of the opening and closing of both the intake and the exhaust engine valves. In the ideal situation, both the timing and the lift of the engine valve can be independently regulated by an electronic control unit depending on the operational needs of the engine intake or exhaust. One method to provide for independent operation of the valves is through a hydraulic actuator where a high pressure hydraulic source is used to supply the energy to open and close the valve according to the position of a hydraulic control valve as determined by an electronic control unit. Prior art devices can be seen by reference to U.S. Pat. Nos. 3,926,159; 4,791,895; 4,930,464; 4,821,689; and 5,255,641 the disclosures which are hereby expressly incorporated by reference.

High speed operation of an engine valve requires precise clearances and operational stability to provide for relatively friction free operation thereby allowing for high speed of response and minimal consumption of energy. To date, the main body of the hydraulic valve actuator has been securely fastened to a portion of the engine thereby contributing to the introduction of frictional forces upon the introduction of high pressure hydraulic oil and/or wear due to long term operation which adversely affects the performance of the valve actuator.

SUMMARY OF THE INVENTION

The present invention includes a variable engine valve control system comprising a free moving engine intake or exhaust valve with a piston attached to its top. The piston is subjected to fluid pressure acting on surfaces on both sides of the piston, with the surfaces being of unequal areas. The volume at one end of the piston is connected to a source of high pressure fluid while the volume at the other end can be connected either to a source of high pressure fluid or to a source of low pressure fluid, or disconnected from them both through action of a controlling means such as a combination solenoid and spool valve.

Selective actuation and de-actuation of the controlling means causes an inflow of pressurized fluid into the volume at one end of the piston and outflow of fluid from the volume at the other end of the piston, such action leading to a change in the balance of forces acting on the piston and causing movement of the engine valve from one fixed position to another.

The inflow of pressurized fluid causes expansion between an upper actuator housing and a lower actuator housing where the upper and lower actuator bodies are slidingly connected and sealed with an annular sealing ring to prevent the migration of high pressure oil. The hydraulic actuator is mounted between two parallel surfaces, an upper surface comprised of an oil supply header having a parallel surface and fixed relative to an engine head surface. The upper actuator housing contacts and seals against the supply header and the lower actuator housing contacts the head surface. The actuator is thus relatively free to move and self-adjust to maintain relatively precise alignment with the engine valve which is piloted on the lower actuator housing. Also, as the upper actuator housing moves upward away from the lower actuator housing, the seal between the upper actuator housing and the supply header is improved.

One provision of the present invention is to allow for the relative movement of the hydraulic valve actuator relative to the engine valve to provide for minimized friction and wear.

Another provision of the present invention is to provide for an upper actuator housing slidingly joined to a lower actuator housing to provide an increased sealing pressure.

Another provision of the present invention is to provide for an upper actuator housing slidingly joined to a lower actuator housing to provide for the relative movement of the valve actuator to an engine valve thereby minimizing friction and wear.

Another provision of the present invention is to provide for an upper actuator housing slidingly connected to a lower actuator housing and sealed against the migration of high pressure hydraulic oil by a sealing ring therebetween where the upper actuator housing and lower actuator housing are relatively free to self-adjust to the alignment of an engine valve.

Still another provision of the present invention is to provide for the expansion control of a hydraulic valve actuator having an upper actuator housing slidingly joined to a lower actuator housing by providing for two fixed parallel surfaces with the hydraulic valve actuator positioned therebetween.

DETAILED DESCRIPTION OF THE PREFERRED EMBODIMENT

Figure 1:
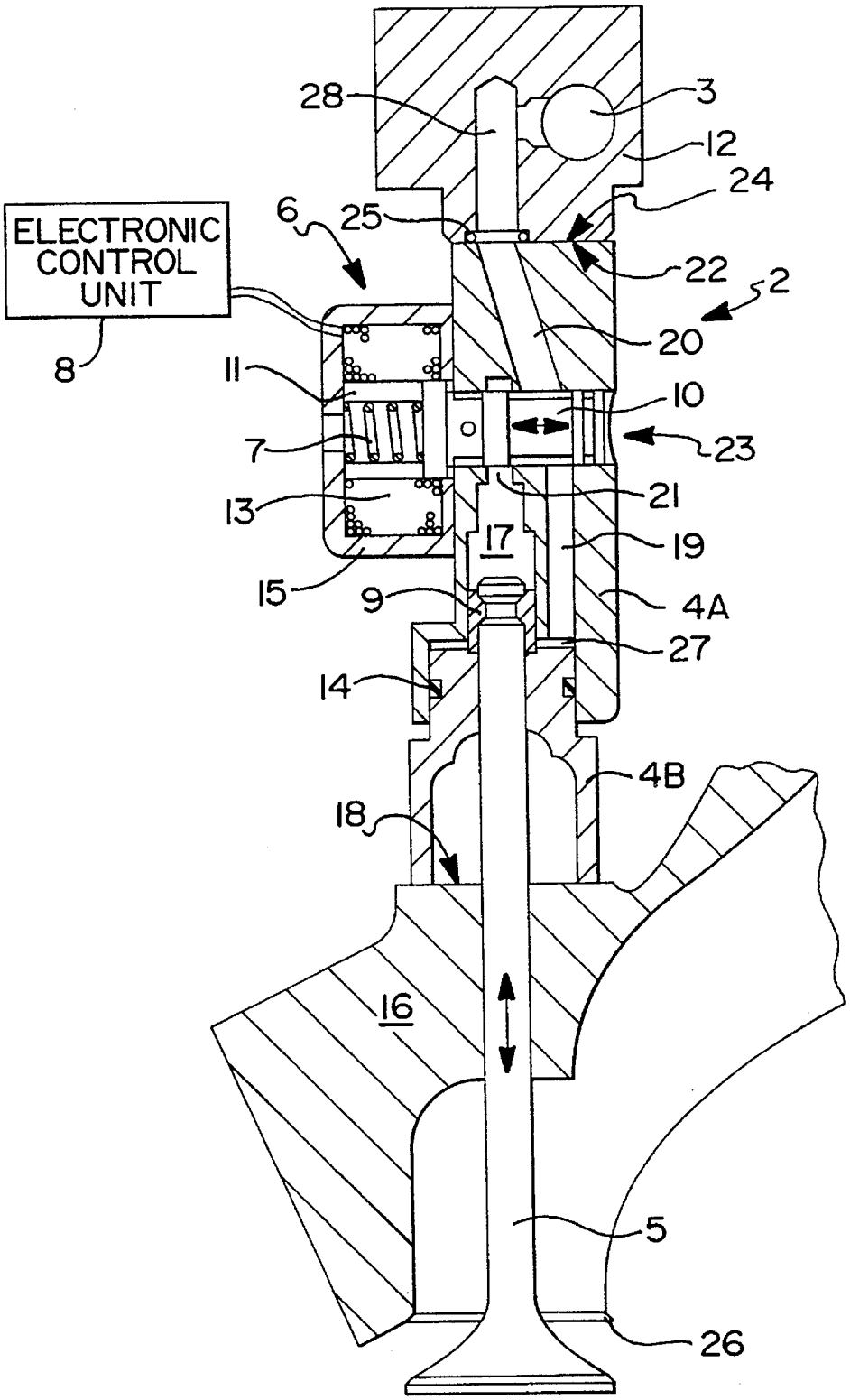
FIG. 1 is a cross-sectional view of the engine valve hydraulic actuator of the present invention.

In this disclosure, certain terminology will be used for convenience and reference only and will not be limiting. For example, the terms "rightward" and "leftward" will refer to directions in the drawings in connection with which the terminology is used. The terms "inwardly" and "outwardly" will refer to directions toward and away from, respectively, the geometrical center of the apparatus being described. The terms "upward" and "downward" will refer to directions as taken in the drawings in connection with which the terminology is used. All foregoing terms include the normal derivatives and equivalents thereof.

Now referring to FIG. 1, the cross-sectional view of the hydraulic actuator 2 of the present invention is shown. A source of high pressure hydraulic oil is fed to the area labeled as oil supply 3 which is used to supply the primary actuation energy to the hydraulic actuator 2 of the present invention to cause an engine valve 5 to translate upwardly and downwardly according to signals supplied by an electronic control unit 8. The hydraulic oil can also be an engine oil as used to supply the basic lubrication to the engine mechanicals.

The hydraulic actuator 2 is comprised of an upper actuator housing 4A slidingly connected to a lower actuator housing 4B. The control solenoid 6 is used to control when the hydraulic actuator 2 is energized or de-energized through the axial motion of the spool valve 10. The spool valve 10 moves laterally leftward and rightward within the valve bore 23 formed in the upper actuator housing 4A so as to control the flow of high pressure oil through the upper actuator housing 4A toward the lower actuator housing 4B and also control the flow of hydraulic oil from the upper actuator housing 4A to atmosphere. When the solenoid 6 is energized, the spool valve 10 is moved magnetically to the left and when de-energized, the spool valve 10 is forced to the right by the return spring 7. The solenoid 6 is comprised of a coil 13 which is wound around a magnetically conductive coil ring 11 and contained by solenoid cover 15 which is mounted to the side of the upper actuator housing 4A. The return spring 7 axially forces the spool valve 10 in a rightward direction so as to cause the hydraulic oil contained in the upper actuator housing 4A to be vented to atmosphere thereby allowing the engine valve 5 to assume its closed position due to the forces generated by the high pressure oil present in lower oil passage 19.

A piston 9 is attached to one end of the engine valve 5 and vertically traverses an upper piston cavity 17 formed in the body of the upper actuator housing 4A as the valve 5 moves upward and downward to open and close at the command of the electronic control unit 8 which sends electrical signals to the control solenoid 6. The lower actuator housing 4B sits on and can move relative to the head surface 18 thereby allowing the lower actuator housing 4B to self-position to minimize friction and wear between the lower actuator housing 4B and the engine valves as they move relative one to the other. The lower actuator housing 4B is hydraulically sealed to the upper actuator housing 4A by way of sealing ring 14 which expands to contact in a sealing manner both the upper and lower actuator housing 4A and 4B.

The supply header 12 is stationary with respect to the engine cylinder head 16 and provides for a stable mounting surface for the hydraulic valve actuator 2. The upper actuator housing 4A has a relatively flat actuator surface 22 which contacts the supply surface 24 where the overall effect is to trap the hydraulic valve actuator 2 between the supply surface 24 and the head surface 18. In this manner, the hydraulic valve actuator 2 is free to position itself between the supply header 12 and the engine cylinder head 16 thereby self-aligning with the engine valve 5 to minimize friction and wear. Header seal 25 functions to seal the upper actuator housing 4A to the supply header 12 to prevent oil leakage. The header seal 25 also introduces sufficient friction on the upper actuator housing 4A in an axial direction to hold the upper actuator housing 4A in position against supply header 12 when the high pressure oil is not present. The header seal 25 is shown as an o-ring but other types of sealing devices can be employed to provide a similar function. As the oil pressure is increased in the upper piston cavity 17, the upper actuator housing 4A tends to separate from the lower actuator housing 4B and the header seal 25 is further compressed by this movement thereby improving the sealing function. The hydraulic pressure forces oil into the clearance between the piston 9 and the adjacent wall in the upper actuator housing 4A which acts to center the upper actuator housing 4A relative to the valve piston 9 and valve 5. Since the lower actuator housing 4B pilots into the upper actuator 4A and is free to slide on the head surface 18 of the cylinder head 16, it centers itself on the stem of engine valve 5.

The oil pressure present in the lower cavity 27 tends to separate the lower actuator housing 4B away from the upper actuator housing 4A thereby forcing the actuator surface 22 toward the supply surface 24. This maintains the compression on the header seal 25 which functions to prevent oil leakage from the supply header 12 which is fixed relative to the cylinder head 16 using a prior art method of fixing its position relative to the cylinder head 16 such as by bolting and bracketry.

Upper oil passage 20 is supplied high pressure oil from the header passage 28 and is sealed to the header passage 28 by header seal 25 so that no leakage occurs. The upper oil passage 20 supplies high pressure oil to the valve bore 23 for distribution to the lower oil passage 19 and the supply flow port 21.

An adjustment feature could be incorporated to adjust the separation between the supply header 12 and the upper actuator housing 4A. Shims (not shown) could be used to move the upper actuator housing 4A downward and thereby change the snubbing point of the hydraulic fluid and the closing velocity of the engine valve 5. The open position is shown in FIG. 1 where the closed position would require the spool valve 10 to be moved by the return spring 7 rightward to lower the oil pressure in the upper piston cavity 17 thereby causing the high pressure oil in the lower oil passage 19 to move the piston 9 upward. The valve 5 stops when it contacts the valve seat 26. Thus, lower or raising the upper actuator housing 4A relative to the oil supply header 12 will result in increasing or decreasing the valve closing velocity. The oil sealing capability of the header seal 25 must be maintained for example, by increasing its thickness to accommodate the increase in separation distance between the supply header 12 and the upper actuator housing 4A.

The description above refers to particular embodiments of the present invention and it is understood that many modifications may be made without departing from the spirit thereof. The embodiments of the invention disclosed and described in the above specification and drawings are presented merely as examples of the invention. Other embodiments, materials, forms and modifications thereof are contemplated as falling within the scope of the present invention only limited by the claims as follows.

I claim:

1. A hydraulic actuator disposed between an engine cylinder head and an oil supply header comprising:

an upper actuator housing contacting and sealing against the oil supply header, said upper actuator housing having a piston contained therein adapted to be moved upward and downward in response to oil pressure from said oil supply header, and said piston is attached to an engine valve;

a lower actuator housing slidingly connected to said upper actuator housing bracket, such that said oil pressure causes said upper actuator housing to be forced against said oil supply header and causes said lower actuator housing to be forced against said cylinder head, and contacting said cylinder head in a manner providing for movement to center said upper actuator housing to said piston and to center said lower actuator housing to said engine valve; and a sealing element disposed between said upper actuator housing and said lower actuator housing.

2. The hydraulic actuator of claim 1, wherein said sealing element is an expandable ring.

3. The hydraulic actuator of claim 1, further comprising a valving means responsive to an electrical signal for controlling the flow of an oil through said upper actuator housing and said lower actuator housing.

4. The hydraulic actuator of claim 3, wherein said valving means is comprised of a solenoid operating a spool valve, said spool valve being axially displaceable within a valve bore formed in said upper actuator housing.

5. The hydraulic actuator of claim 1, wherein a position of said upper actuator housing relative to said cylinder head can be adjusted to provide for proper closing velocity of said engine valve.

6. A hydraulic actuator operating an engine valve comprising:

an engine cylinder head containing an engine valve, said cylinder head having a relatively flat support surface;

an oil supply header for channeling a source of high pressure oil to the hydraulic valve actuator said supply header having a supply sealing surface stationary and parallel relative to said support surface;

an upper actuator housing having a first end contacting said supply sealing surface and a second end extending toward said cylinder head, said upper actuator housing having a piston contained therein adapted to be moved upward and downward in response to oil pressure from said oil supply header where said piston is attached to said engine valve;

a lower actuator housing having a first end slidingly connected to said second end of said upper actuator housing and a second end contacting said cylinder head;

sealing means disposed between said upper actuator housing and said lower actuator housing; and valving means responsive to an electrical control signal for controlling a flow of said high pressure oil through said upper actuator housing and said lower actuator housing.

7. The hydraulic actuator of claim 6, wherein said valving means is comprised of a solenoid operating a spool valve, said spool valve being axially displaceable within a valve bore formed in said upper actuator housing.

8. The hydraulic actuator of claim 6, wherein said sealing means is an expandable ring.

9. The hydraulic actuator of claim 6, wherein a position of said upper actuator housing relative to said cylinder header can be adjusted to provide for proper closing velocity of said engine valve.

* * * * *